United States Patent [19]

Wedel

[11] Patent Number: 4,891,891

[45] Date of Patent: Jan. 9, 1990

[54] DRYER SECTION APPARATUS AND METHOD

[75] Inventor: Gregory L. Wedel, Beloit, Wis.

[73] Assignee: Beloit Corporation, Beloit, Wis.

[21] Appl. No.: 256,347

[22] Filed: Oct. 11, 1988

[51] Int. Cl.[4] ..... F26B 3/04

[52] U.S. Cl. ..... 34/23; 34/114; 34/116; 34/123

[58] Field of Search ..... 34/114, 115, 116, 117, 34/23; 162/290

[56] References Cited

U.S. PATENT DOCUMENTS 4,539,762 9/1985 Esitelinen et al. ..... 34/114 X 4,669,189 6/1987 Wedel ..... 34/116

*Primary Examiner*—Henry A. Bennet

*Assistant Examiner*—John Solleato

*Attorney, Agent, or Firm*—Dirk J. Veneman; Raymond W. Campbell; David J. Archer

[57] ABSTRACT

A dryer section apparatus is disclosed for drying a web. The apparatus includes a first and second tier of dryers which include, respectively, a first, second dryer and a third dryer. The arrangement is such that the web moves from the first dryer towards and around the third dryer and subsequently to and around the second dryer. A transfer roll is disposed between the first, second and third dryers such that the distance between the transfer roll and the first dryer is less than the distance between the transfer roll and the second dryer. A dryer felt extends contiguously with the web around the first dryer with the felt then extending around the transfer roll and thereafter around the second dryer such that a pocket is defined between the web extending between the dryers, the third dryer and the felt. A blow box is disposed between the roll and the the first and second dryers with the box being disposed outside the pocket for blowing a first current of air into the pocket through the felt extending between the first dryer and the roll. The first current of air augments a first flow of air flowing into the pocket through the felt extending between the first dryer and the roll to balance a second flow of air flowing out of the pocket through the felt extending between the roll and the second dryer.

11 Claims, 3 Drawing Sheets

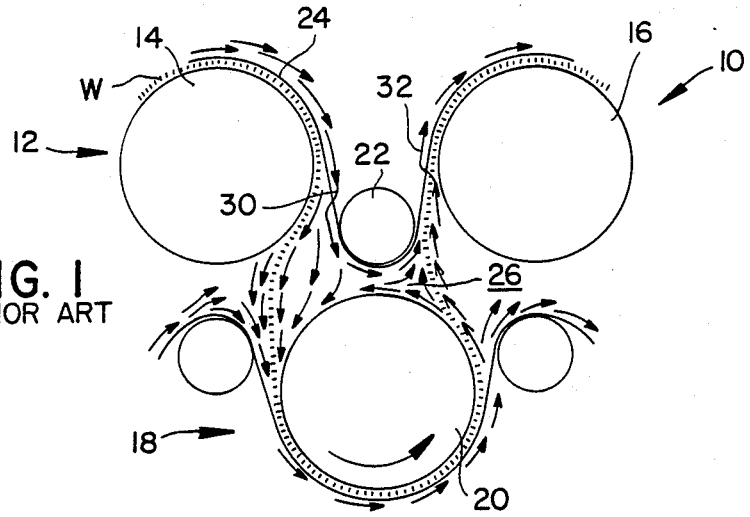
FIG. 1
PRIOR ART
FIG. 2
PRIOR ART
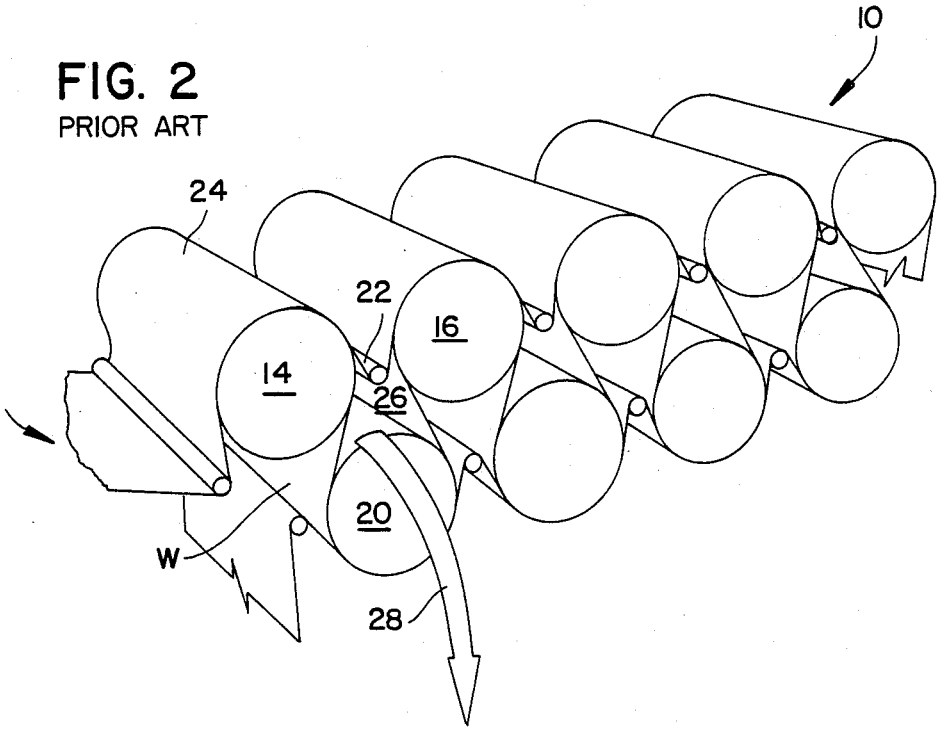

FIG. 3
PRIOR ART
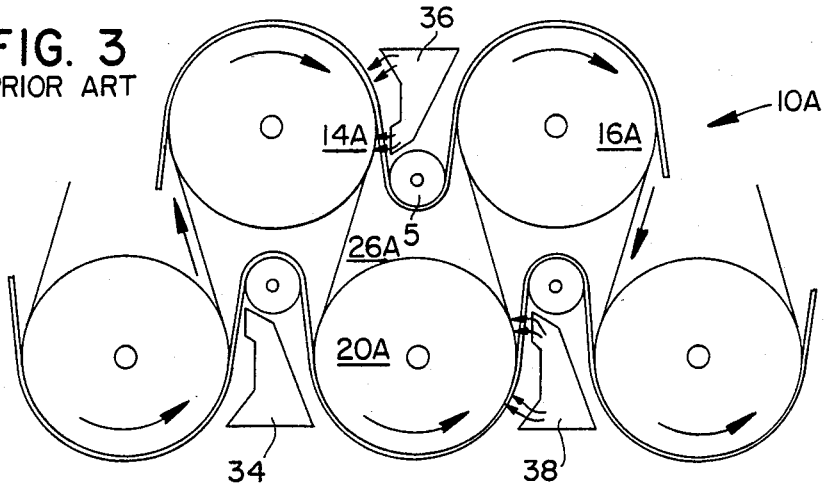
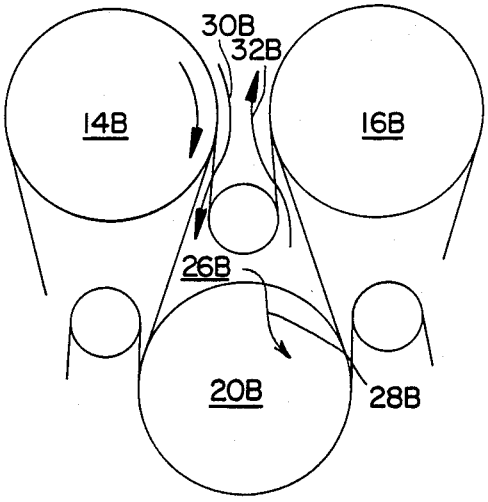
FIG. 4
PRIOR ART
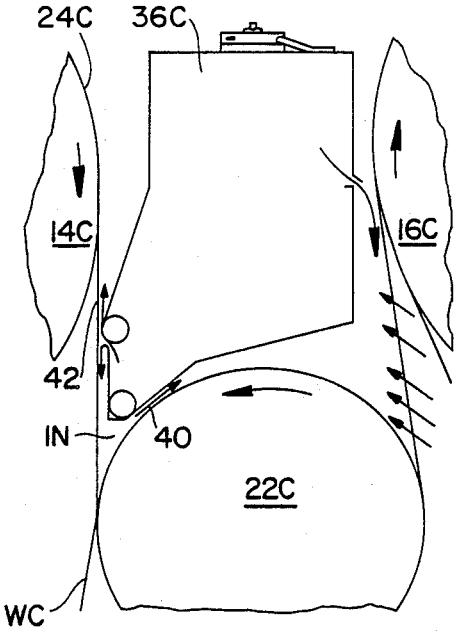
FIG. 5
PRIOR ART

DRYER SECTION APPARATUS AND METHOD

BACKGROUND OF THE INVENTION

Field of the Invention

This invention relates to a dryer section apparatus and a method for drying a web. More particularly, the present invention relates to a dryer section apparatus including two tiers of dryers in which the web extends in an open draw between the tiers.

INFORMATION DISCLOSURE STATEMENT

In a conventional, double-felted, two-tier dryer section, the sheet is transferred from one dryer to the next dryer through unsupported spans called "open draws". A significant portion of the moisture in the sheet evaporates from the web as it passes through such "open draws". The sheet, the dryer surfaces and the felts form a series of enclosed dryer pockets, the ends of which are open to the dryer section machine room. The water vapor which leaves the sheet in these "open draws" tends to accumulate within such enclosed pockets. The high humidity then diffuses along each pocket toward the open ends of the pocket. The highest pocket humidity remains near the center of the pocket and the lowest pocket humidity occurs near the lateral edges of the pocket. The resultant high pocket humidities tend to reduce the drying rate and cause non-uniformity in the drying rate in the cross-machine direction.

In order to dilute the humid air and purge the air from the dryer pocket, pocket ventilating ducts of the type shown in U.S. Pat. No. 3,384,973 to Johansson are utilized. Such ducts are located outside the pocket next to the pocket felt transfer rolls. Such ducts then blow dry air through the felt and into the dryer pockets. Since there is a natural tendency for air to be pumped into the pocket through the ingoing nip defined between the felt and the transfer roll, the pocket ventilating ducts are generally arranged to supply the dry air into the aforementioned ingoing nip.

Additionally, there is also a natural tendency for air to be pumped out of the dryer pocket through the outgoing nip defined between the felt and the associated dryer. Typically, the amount of air which is pumped into the pocket exceeds the amount of air which is pumped out of the pocket. The excess air within the pockets of necessity flows out of the ends of the pockets. Such natural air flow imbalance is further aggravated by blowing additional air into the ingoing nip with the pocket ventilating ducts.

The air flow which flows out of the ends of the dryer pocket due to such imbalance tends to cause the edges of the sheet to flutter in the "open draws". Such edge flutter can be reduced by reducing the pocket ventilating air flow rate. However, this is contrary to the need to ventilate the pocket.

The natural air flow imbalance can also be reduced by decreasing the permeability of the dryer felts. Such reduction in permeability reduces the amount of air which is pumped in and out of the pocket as well as the imbalance volume flow rate. However, this is also contrary to the need for pocket ventilation.

A further approach to reducing the imbalance while providing a more stable open draw transfer is described in U.S. Pat. No. 4,694,587 to Eskelinen. The aforementioned patent teaches pocket ventilating ducts which are located adjacent to the felt rolls with two cross-machine air jets which are both directed away from the ingoing nip between the felt and transfer roll. Such jets induce a vacuum which tends to hold the web in contact with the felt for a substantial portion of the open draw length. Not only does this tend to reduce the effective length of the open draw but also provides improved sheet stability.

The foregoing arrangement, however, achieves the improved stability by preventing the natural flow of air into the dryer pocket. A natural flow of air continues to leave the pocket through the outgoing nip defined by the felt and associated dryer and this results in an imbalanced pocket with no ventilation. The aforementioned patent suggests using an additional air jet to particularly block the outflow of air from the outgoing nip. In addition to increasing the air flow requirements for the pocket ventilating duct, such third air nozzle requires a high volume flow rate to counter the natural outflow of air from the pocket. If the third nozzle is successful in forcing some dry air back into the pocket, then the pocket is again imbalanced.

The present invention seeks to overcome the aforementioned problem by providing a more stable sheet in the open draw transfers by ventilating the pocket with dry air by utilizing the natural tendency of the air to enter the ingoing nip and to maintain a balanced pocket with minimum inflow or outflow at the ends of the pocket.

The aforementioned objectives are accomplished by offsetting the felt rolls in the dryer pocket and providing a special ventilation duct. Specifically, the felt roll is offset towards the tangent between the first and third dryers such that the angle between the aforementioned tangent line and the dryer felt between the first dryer and the transfer roll is within the range 1° to 12°. The pocket ventilating duct is then located adjacent to the transfer roll outside the dryer pocket.

The duct has four air nozzles of which two are disposed in a cross-machine direction and the remaining two air nozzles are disposed in a machine direction. The first cross-machine direction nozzle blows air directly into the ingoing nip whereas the second cross-machine nozzle blows a jet of air in a direction substantially opposite to the running direction of the felt. The two machine direction nozzles are located near the edges of the box and these nozzles blow air in an outward direction. The first cross-machine nozzle serves two purposes. First, the nozzle blows air into the ingoing nip and through the felt. Second, at high speeds, the air is accelerated by the moving felt and discharged into the dryer pocket. The accelerated air tends to induce a slight vacuum which maintains the sheet in stable contact with the felt until the sheet reaches the roll centerline. The air then gently forces the sheet off of the felt and provides a uniform release near the felt tangent point. The air then enters the pocket and dilutes the humid air.

The second cross-machine nozzle also has two functions. First, it tends to strip away the humid air which is following the dryer felt and, secondly, the nozzle prevents the humid air from entering the dryer pocket. The second jet also induces a slight vacuum which tends to hold the sheet in contact with the felt.

Because the felt roll is offset near the ingoing nip, the amount of air which is naturally pumped into the pocket is reduced.

The inflow of air into the pocket is then controlled by adjustment of the pocket ventilating duct flow rate. The natural outflow from the pocket at the same time is increased by offsetting the felt roll. This results in a dryer pocket which is naturally negatively balanced, that is, air must flow in the ends of the dryer pockets. In such condition, the supply of air to the pocket ventilating duct can be increased to provide not only a balanced pocket but also ventilation air.

Therefore, it is a primary object of the present invention to overcome the aforementioned inadequacies of the prior art arrangements and to provide a dryer section apparatus that makes a considerable contribution to the art of drying a web.

SUMMARY OF THE INVENTION

The present invention relates to a dryer section apparatus and a method for drying a web. The apparatus includes a first tier of rotatable dryers, the first tier including a first dryer with the web extending around the first dryer and a second dryer disposed downstream relative to the first dryer. A second tier of rotatable dryers includes a third dryer which is disposed downstream relative to the first dryer and upstream relative to the second dryer such that the web moves from the first dryer towards and around the third dryer and subsequently to and around the second dryer.

A transfer roll is disposed between the first, second and third dryers such that the distance between the transfer roll and the first dryer is less than the distance between the transfer roll and the second dryer. A dryer felt extends contiguously with the web around the first dryer with the felt then extending around the transfer roll and thereafter around the second dryer such that a pocket is defined between the web extending between the dryers, the third dryer and the felt. A blow box is disposed between the roll and the first and second dryers with the box being disposed outside the pocket for blowing a first current of air into the pocket through the felt extending between the first dryer and the roll. The first current of air augments a first flow of air flowing into the pocket through the felt extending between the first dryer and the roll to balance the second flow of air flowing out of the pocket through the felt extending between the roll and the second dryer.

In a more specific embodiment of the present invention, the axis of rotation of each dryer of the first tier is disposed in a first plane and the axis of rotation of the each dryer of the second tier is disposed in a second plane with the second plane being parallel and spaced relative to the first plane.

The web extends in a first open draw between the first dryer and the third dryer with the web also extending in a second open draw from the third dryer to the second dryer. The first and second draws are equal in length.

The transfer roll is spaced relative to the first draw and a further dryer felt extends contiguously with the web around the third dryer.

In a specific embodiment of the present invention, the dryer felt extends between the first dryer and the roll to define an angle within the range 1° to 12° relative to the first draw.

The blow box is connected to a source of pressurized air such that the first current of air flows through a slot defined by the blow box. The slot extends in a cross-machine direction across the width of the web so that the first current of air flows through the felt in the vicinity of an ingoing nip defined between the felt and the roll.

The blow box defines a cross-machine direction opening such that a second current of air flows from the blow box through the opening in a direction opposite to the direction of the movement of the felt moving between the first and the third dryers for removing humid boundary layer air following the first dryer.

The blow box also defines a first and second edge slot. The edge slots extend in a machine direction so that a first and second curtain of air flow outwardly through the edge slots towards the felt extending between the first and third dryers for reducing edge flutter of the respective edges of the web extending in an open draw between the first and the third dryers.

The present invention also includes a method of drying a web which includes the steps of guiding the web around a first dryer for drying the web. Thereafter, the web is guided in a first open draw from the first dryer to and around a third dryer. The web is guided from the third dryer to and around a second dryer with the first and second dryers being included in a first tier and the third dryer being include in a second tier. A dryer felt is guided contiguously with the web around the first dryer. Thereafter, the dryer felt is led from the first dryer to and around a transfer roll and from the transfer roll to and around the second dryer such that a pocket is defined between the web extending between the dryers, the third dryer and the dryer felt extending between the first and the second dryers.

The transfer roll is offset such that the distance between the transfer roll and the first dryer is less than the distance between the transfer roll and the second dryer. Finally, a first current of air is blown from a blow box through the felt extending between the first dryer and the transfer roll. The first current of air augments a first flow of air flowing into the pocket through the felt extending between the first dryer and the roll to balance a second flow of air flowing out of the pocket through the felt extending between the roll and the second dryer such that cross-machine directional flow of air relative to the pocket is minimized.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

FIG. 1 is an elevational view of a prior art double-felted dryer section apparatus;

FIG. 2 is a perspective view of the apparatus shown in FIG. 1 but showing the lateral flow of air out of the dryer pockets;

FIG. 3 is an elevational view of a prior art double-felted dryer section apparatus as shown in U.S. Pat. No. 3,384,973, showing the utilization of various blow boxes;

FIG. 4 is an elevational view of a prior art double-felted dryer section apparatus showing the inflow of air into the pocket and the outflow of air therefrom, the inflow and outflow being unbalanced thereby resulting in a cross-machine directional flow out of the pocket;

FIG. 5 is an elevational view of a prior art blow box shown in U.S. Pat. No. 4,694,587 showing air flows in a direction away from the ingoing nip;

DETAILED DESCRIPTION OF THE DRAWINGS

Figure 6:
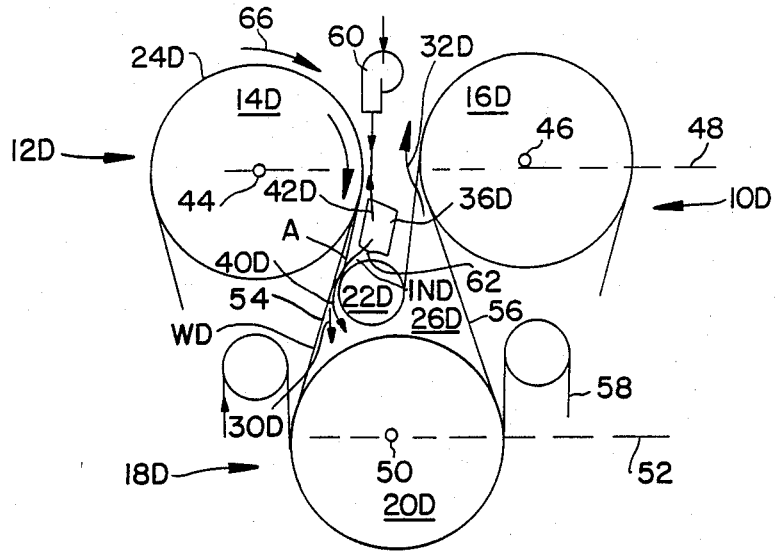
FIG. 6 is an elevational view of a dryer section apparatus according to the present invention showing the transfer roll offset to the wet end of the dryer section.

FIG. 1 is an elevational view of a prior art dryer section apparatus generally designated 10 for drying a web W. The apparatus 10 includes a first tier generally designated 12 of rotatable dryers. The first tier 12 includes a first dryer 14 and a second dryer 16 with the web W extending around the first dryer 14. The second dryer 16 is disposed downstream relative to the first dryer 14. A second tier generally designated 18 of rotatable dryers includes a third dryer 20 disposed downstream relative to the first dryer 14 and upstream relative to the second dryer 16 such that the web W moves from the first dryer 14 towards and around the third dryer 20 and subsequently to and around the second dryer 16.

A transfer roll 22 is disposed between the first, second and third dryers 14, 16 and 20 respectively such that the distance between the transfer roll 22 and the first dryer 14 is equal to the distance between the transfer roll 22 and the second dryer 16.

A dryer felt 24 extends contiguously with the web W around the first dryer 14 with the felt 24 then extending around the transfer roll 22 and thereafter around the second dryer 16 such that a pocket 26 is defined between the web W extending between the dryers 14, 20 and 16, the third dryer 20 and the felt 24.

FIG. 2 is a perspective view of the prior art dryer section apparatus 10 shown in FIG. 1. The arrow 28 shows the outflow of air laterally away from the pocket 26 in view of the imbalance within the pocket 26 caused by the inflow of air as indicated by the arrow 30 shown in FIG. 1 through the felt 24 being more than the outflow of air as indicated by the arrow 32 through the felt between the transfer roll 22 and the downstream dryer 16.

FIG. 3 is an elevational view of a prior art double-felted dryer section apparatus generally designated 10A as shown in U.S. Patent No. 3,384,973. The apparatus 10A includes a plurality of blow boxes 34, 36 and 38. The box 36 is arranged for blowing dry air into a pocket 26A defined between dryers 14A, 20A and 16A.

FIG. 4 is an elevational view of a prior art double-felted dryer section apparatus 10B in which the inflow of air represented by the arrow 30B is more than the outflow of air as represented by the arrow 32B from the pocket 26B. The resultant imbalance within the pocket 26B is compensated for by a lateral outflow of air from the pocket as indicated by the arrow 28B.

FIG. 5 is an elevational view of a blow box 36C described in U.S. Pat. No. 4,694,587 and shows two currents of air 40 and 42 flowing from the blow box 36C with both currents 40 and 42 flowing in a direction away from the ingoing nip IN defined between the transfer roll 22C and the dryer felt 24C.

FIG. 6 is an elevational view of a dryer section apparatus generally designated 10D according to the present invention for drying a web WD. The apparatus 10D comprises a first tier 12D of rotatable dryers. The first tier 12D includes a first dryer 14D with the web WD extending around the first dryer 14D. The first tier 12D also includes a second dryer 16D disposed downstream relative to the first dryer 14D. A second tier 18D of rotatable dryers includes a third dryer 20D disposed downstream relative to the first dryer 14D and upstream relative to the second dryer 16D such that the web WD moves from the first dryer 14D towards and around the third dryer 20D and subsequently to and around the second dryer 16D. A transfer roll 22D is disposed between the first, second and third dryers 14D, 16D and 20D respectively such that the distance between the transfer roll 22D and the first dryer 14D is less than the distance between the transfer roll 22D and the second dryer 16D.

A dryer felt 24D extends contiguously with the web WD around the first dryer 14D. The felt 24D then extends around the transfer roll 22D and thereafter around the second dryer 16D such that a pocket 26D is defined between the web WD extending between the dryers 14D, 20D and 16D, the third dryer 20D and the felt 24D. A blow box 36D is disposed between the roll 22D and the first and second dryers 14D and 16D. The box 36D is disposed outside the pocket 26D for blowing a first current of air as indicated by the arrow 40D into the pocket 26D through the felt 24D extending between the first dryer 14D and the roll 22D. The first current of air 40D augments a first flow of air as indicated by the arrow 30D flowing into the pocket 26D through the felt 24D extending between the first dryer 14D and the roll 22D to balance a second flow of air as indicated by the arrow 32D flowing out of the pocket 26D through the felt 24D extending between the roll 22D and the second dryer 16D.

The axis of rotation 44 and 46 respectively of each dryer 14D and 16D of the first tier 12D is disposed in a first plane 48. Furthermore, the axis of rotation 50 of the dryer 20D of the second tier 18D is disposed in a second plane 52 with the second plane 52 being parallel and spaced relative to the first plane 48.

As shown in FIG. 6, the web WD extends in a first open draw 54 between the first dryer 14D and the third dryer 20D with the web WD also extending in a second open draw 56 from the third dryer 20D to the second dryer 16D. The first and second draws 54 and 56 respectively are equal in length.

The transfer roll 22D is spaced relative to the first draw 54 as shown in FIG. 6.

Furthermore, as shown in FIG. 6, a further dryer felt 58 extends contiguously with the web WD around the third dryer 20D.

The dryer felt 24D extends between the first dryer 14D and the roll 22D to define an angle A within the range 1° to 12° relative to the first draw 54.

In a specific embodiment of the present invention, the aforementioned range includes an angle up to 10°.

The blow box 36D shown in FIG. 6 is connected to a source of pressurized air 60 such that the first current of air 40D flows through a first slot 62 defined by the blow box 36D.

Figure 7:
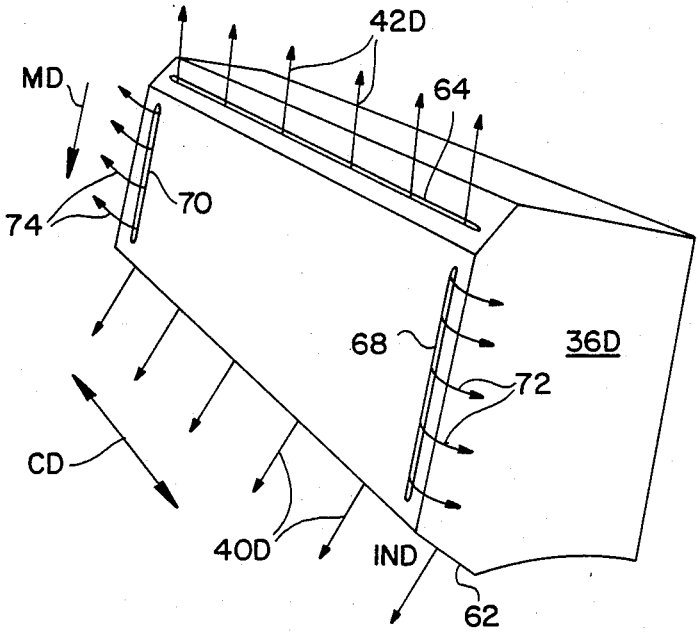
FIG. 7 is an enlarged perspective view of the blow box shown in FIG. 6.

FIG. 7 is a more detailed perspective view of the blow box 36D and shows the first slot 62 extending in a cross-machine direction as indicated by the arrow CD across the width of the web WD so that the first current of air 40D flows through the felt 24D in the vicinity of an ingoing nip IND defined between the felt 24D and the roll 22D.

As shown in FIG. 7, the blow box 36D also defines a cross-machine direction opening 64 such that a second current of air as indicated by the arrow 42D flows from the blow box 36D through the opening 64 in a direction opposite to the direction of movement of the felt 24D moving between the first and third dryers 14D and 20D respectively for removing humid boundary layer air 66 following the first dryer 14D as shown in FIG. 6.

The blow box 36D shown in FIG. 7 also defines a first and second edge slot 68 and 70 respectively. The edge slots 68 and 70 extend in a machine direction as indicated by the arrow MD so that a first and second curtain of air as indicated by the arrows 72 and 74 respectively flows outwardly through the edge slots 68 and 70 respectively towards the felt 24D extending between the first and third dryers 14D and 20D for reducing edge flutter of the respective edges of the web WD extending in the open draw 54 between the first and third dryers 14D and 20D.

In operation of the dryer section apparatus according to the present invention as shown in FIGS. 6 and 7, the transfer roll 22D is offset towards the first dryer 14D thereby decreasing the amount of air 30D pumped into the pocket 26D while increasing the amount of air 32D pumped out of the pocket 26D. Accordingly, the imbalance within the pocket 26D would cause a lateral inflow of compensating air into the pocket 26D were it not for the provision of the blow box 36D. The blow box 36D provides a first current of air 40D to augment the air flow 30D so that the combined flows 40D and 30D are in balance with the flow 32D thereby minimizing the lateral flow of air into or out of the pocket 26D.

Additionally, the second current of air 42D inhibits the flow of humid boundary air 66 into the pocket 26D and the first current of air 40D assists in the release of the web WD from the felt 24D extending between the first dryer 14D and the third dryer 20D.

The present invention, by utilizing a combination of an offset transfer roll and blow box, enables the maintenance of a balance within the pocket of a dryer section apparatus while supplying the pocket with a continuous supply of dry air through the blow box.

What is claimed is:

1. A dryer section apparatus for drying a web, said apparatus comprising:

a first tier of rotatable dryers;

said first tier including:

a first dryer, the web extending around said first dryer;

a second dryer disposed downstream relative to said first dryer;

a second tier of rotatable dryers;

said second tier including:

a third dryer disposed downstream relative to said first dryer and upstream relative to said second dryer such that the web moves from said first dryer towards and around said third dryer and subsequently to and around said second dryer;

a transfer roll disposed between said first, second and third dryers such that the distance between said transfer roll and said first dryer is less than the distance between said transfer roll and said second dryer;

a dryer felt extending contiguously with the web around said first dryer, said felt then extending around said transfer roll and thereafter around said second dryer such that a pocket is defined between the web extending between said dryers, said third dryer and said felt; and a blow box disposed between said roll and said first and second dryers, said box being disposed outside said pocket for blowing a first current of air into said pocket through said felt extending between said first dryer and said roll, said first current of air augmenting a first flow of air flowing into said pocket through said felt extending between said first dryer and said roll to balance a second flow of air flowing out of said pocket through said felt extending between said roll and said second dryer.

2. A dryer section apparatus as set forth in claim 1 wherein:

the axis of rotation of each dryer of said first tier is disposed in a first plane;

the axis of rotation of each dryer of said second tier is disposed in a second plane, said second plane being parallel and spaced relative to said first plane.

3. A dryer section apparatus as set forth in claim 1 wherein the web extends in a first open draw between said first dryer and said third dryer, the web also extending in a second open draw from said third dryer to said second dryer, said first and second draws being equal in length.

4. A dryer section apparatus as set forth in claim 3 wherein said transfer roll is spaced relative to said first draw.

5. A dryer section apparatus as set forth in claim 1 further including:

a further dryer felt extending contiguously with the web around said third dryer.

6. A dryer section apparatus as set forth in claim 1 wherein said blow box is connected to a source of pressurized air such that said first current of air flows through a slot defined by said blow box, said slot extending in a cross-machine direction across the width of the web so that said first current of air flows through said felt in the vicinity of an ingoing nip defined between said felt and said roll.

7. A dryer section apparatus as set forth in claim 1 wherein said blow box defines a cross-machine direction opening such that a second current of air flows from said blow box through said opening in a direction opposite to the direction of movement of said felt moving between said first and third dryers for removing humid boundary layer air following said first dryer.

8. A dryer section apparatus as set forth in claim 1 wherein said blow box defines a first and second edge slot, said edge slots extending in a machine direction so that a first and second curtain of air flows outwardly through said edge slots towards said felt extending between said first and third dryers for reducing edge flutter of the respective edges of the web extending in an open draw between said first and third dryers.

9. A dryer section apparatus for drying a web, said apparatus comprising:

a first tier of rotatable dryers;

said first tier including:

a first dryer, the web extending around said first dryer;

a second dryer disposed downstream relative to said first dryer;

a second tier of rotatable dryers;

said second tier including:

a third dryer disposed downstream relative to said first dryer and upstream relative to said second dryer such that the web moves from said first dryer towards and around said third dryer and subsequently to and around said second dryer;

a transfer roll disposed between said first, second and third layers such that the distance between said transfer roll and said first dryer is less than the distance between said transfer roll and said second dryer;

a dryer felt extending contiguously with the web around said first dryer, said felt then extending around said transfer roll and thereafter around said second dryer such that a pocket is defined between the web extending between said dryers, said third dryer and said felt;

a blow box disposed between said roll and said first and second dryers, said box being disposed outside said pocket for blowing a first current of air into said pocket through said felt extending between said first dryer and said roll, said first current of air augmenting a first flow of air flowing into said pocket through said felt extending between said first dryer and said roll to balance a second flow of air flowing out of said pocket through said felt extending between said roll and said second dryer;

the web extending in a first open draw between said first dryer and said third dryer, the web also extending in a second open draw from said third dryer to said second dryer, said first and second draws being equal in length; and said dryer felt extending between said first dryer and said roll defining an angle within the range 1° to 12° relative to said first draw.

10. A dryer section apparatus for drying a web, said apparatus comprising:

a first tier of rotatable dryers;

said first tier including:

a first dryer, the web extending around said first dryer;

a second dryer disposed downstream relative to said first dryer;

a second tier of rotatable dryers;

said second tier including:

a third dryer disposed downstream relative to said first dryer and upstream relative to said second dryer such that the web moves from said first dryer towards and around said third dryer and subsequently to and around said second dryer;

a transfer roll disposed between said first, second and third dryers such that the distance between said transfer roll and said first dryer is less than the distance between said transfer roll and said second dryer;

a dryer felt extending contiguously with the web around said first dryer, said felt then extending around said transfer roll and thereafter around said second dryer such that a pocket is defined between the web extending between said dryers, said third dryer and said felt;

a blow box disposed between said roll and said first and second dryers, said box being disposed outside said pocket for blowing a first current of air into said pocket through said felt extending between said first dryer and said roll, said first current of air augmenting a first flow of air flowing into said pocket through said felt extending between said first dryer and said roll to balance a second flow of air flowing out of said pocket through said felt extending between said roll and said second dryer; and the web extending in a first open draw between said first dryer and said third dryer, the web also extending in a second open draw from said third dryer to said second dryer such that said dryer felt extending between said first dryer and said roll defines an angle within the range 1° to 12° relative to said first draw.

11. A method of drying a web extending through a dryer section apparatus, the method comprising the steps of:

guiding the web around a first dryer for drying the web;

guiding the web in a first open draw from the first dryer to and around a third dryer;

guiding the web from the third dryer to and around a second dryer, the first and second dryers being included in a first tier, the third dryer being included in a second tier;

guiding a dryer felt disposed contiguously with the web around the first dryer;

leading the dryer felt from the first dryer to and around a transfer roll and thereafter from the transfer roll to and around the second dryer such that a pocket is defined between the web extending between the dryers, the third dryer and the dryer felt extending between the first and second dryers;

offsetting the transfer roll such that the distance between the transfer roll and the first dryer is less than the distance between the transfer roll and the second dryer; and blowing a first current of air from a blow box through the felt extending between the first dryer and the transfer roll, the first current of air augmenting a first flow of air flowing into the pocket through the felt extending between the first dryer and the roll to balance a second flow of air flowing out of the pocket through the felt extending between the roll and the second dryer such that cross-machine directional flow of air relative to the pocket is minimized.

* * * * *

UNITED STATES PATENT AND TRADEMARK OFFICE

CERTIFICATE OF CORRECTION

PATENT NO. : 4,891,891

DATED : January 9, 1990

INVENTOR(S) : Gregory L. Wedel

It is certified that error appears in the above—identified patent and that said Letters Patent is hereby corrected as shown below:

Column 8: line 67, delete "layers" and insert therefor --dryers--.

Signed and Sealed this

Eighteenth Day of December, 1990

*Attest:*

HARRY F. MANBECK, JR.

*Attesting Officer*

*Commissioner of Patents and Trademarks*